US011371158B2

(12) United States Patent
Furukawa et al.

(10) Patent No.: US 11,371,158 B2
(45) Date of Patent: Jun. 28, 2022

(54) SURFACE TREATMENT DEVICE

(71) Applicant: HONDA MOTOR CO., LTD., Tokyo (JP)

(72) Inventors: Yuki Furukawa, Tochigi (JP); Masahiro Yamanaka, Tochigi (JP); Tatsuya Sasaki, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 298 days.

(21) Appl. No.: 16/498,637

(22) PCT Filed: Mar. 30, 2018

(86) PCT No.: PCT/JP2018/013741

§ 371 (c)(1),
(2) Date: Sep. 27, 2019

(87) PCT Pub. No.: WO2018/181941

PCT Pub. Date: Oct. 4, 2018

(65) Prior Publication Data

US 2020/0407868 A1 Dec. 31, 2020

(30) Foreign Application Priority Data

Mar. 31, 2017 (JP) ..... JP2017-071316

(51) Int. Cl.
*C25D 17/12* (2006.01)
*C25D 5/02* (2006.01)
*C25D 7/04* (2006.01)

(52) U.S. Cl.
CPC ..... *C25D 17/12* (2013.01); *C25D 5/026* (2013.01); *C25D 7/04* (2013.01)

(58) Field of Classification Search
None
See application file for complete search history.

(56) References Cited

U.S. PATENT DOCUMENTS

2010/0078326 A1 4/2010 Muramatsu et al.
2015/0273602 A1* 10/2015 Mukai ..... B23H 9/16 204/224 M
2017/0334008 A1* 11/2017 Filipovic ..... B23H 7/28

FOREIGN PATENT DOCUMENTS

CN 101713090 A 5/2010
CN 205474080 8/2016
(Continued)

OTHER PUBLICATIONS

International Search Report, dated Jun. 26, 2018 (dated Jun. 26, 2018), 1page.
Chinese Office Action dated Jan. 21, 2021, 6 pages.

*Primary Examiner* — Stefanie S Wittenberg
(74) *Attorney, Agent, or Firm* — Rankin, Hill & Clark LLP

(57) ABSTRACT

An electrode device is provided with a closed part facing a bottom part of a bottomed hole when inserted inside the bottomed hole, and a flow through hole linking the inside and outside of the electrode device is formed in the electrode device. When surface treatment is implemented on the inner wall surface of the bottomed hole, the hollow electrode device is inserted into the inside of the bottomed hole, the electrolytic treatment solution is made to flow through the space inside the bottomed hole, and power is applied across the electrode device and the inner wall surface of the bottomed hole. The closed part faces the bottom part of the bottomed hole as an electrode across a prescribed surface area; therefore, electroplating at the bottom part of the bottomed hole proceeds to the same extent as other sites.

4 Claims, 7 Drawing Sheets

(56) References Cited

FOREIGN PATENT DOCUMENTS

| | | | | | |
|---|---|---|---|---|---|
| CN | 205635820 | U | 10/2016 | | |
| JP | H10-147896 | | 6/1998 | | |
| JP | 2007-039779 | | 2/2007 | | |
| JP | 2013-159832 | | 8/2013 | | |
| JP | 2015-030897 | | 2/2015 | | |
| RU | 1620231 | * | 1/2019 | ..... | B23H 1/04 |

* cited by examiner

SURFACE TREATMENT DEVICE

TECHNICAL FIELD

The present invention relates to a surface treatment device that performs surface treatment such as electroplating, electrodeposition coating, or electrolytic polishing at an inner wall surface of a bottomed hole formed as a cooling passage in a casting mold, for example.

BACKGROUND ART

In the related art, as this type of surface treatment device, a surface treatment device including a hollow (pipe-shaped) electrode facing an inner wall surface of a bottomed hole of a casting mold is proposed (for example, see Patent Document 1).

In this manner, when the surface treatment device is used to implement surface treatment at the inner wall surface of the bottomed hole of the casting mold, the hollow electrode is inserted and installed inside the bottomed hole to have a prescribed gap from the bottomed hole. In this state, an electrolytic treatment solution is made to flow through a space between an outer peripheral surface of the electrode and the inner wall surface of the bottomed hole and a space inside the hollow electrode, and power is applied across the electrode and the casting mold. In the surface treatment device, since the electrode has a hollow shape, the space inside the electrode is used as a flow passage of the electrolytic treatment solution, and thereby an advantage is obtained in that the electrolytic treatment solution is sufficiently circulated to a bottom part of the bottomed hole.

In addition, another surface treatment device is also proposed, the surface treatment device including, so to speak, an electrode having a double pipe structure in which, when a bottomed hole of a casting mold has a stepped shape (that is, shape having a size of an inner diameter which changes from an opening to the bottom part of the bottomed hole), a hollow small-diameter electrode pipe having a shape corresponding to a small-diameter part of the bottomed hole is inserted into a space inside a hollow large-diameter electrode pipe having a shape corresponding to a large-diameter part of the bottomed hole and projects at a front end side such that the electrode can correspond to the stepped shape (for example, see Patent Document 2).

In this manner, when the surface treatment device is used to implement surface treatment at an inner wall surface of the bottomed hole having the stepped shape, the large-diameter electrode pipe and the small-diameter electrode pipe of an electrode device are inserted and installed in the large-diameter part and the small-diameter part of the bottomed hole, respectively, to have a prescribed gap from the bottomed hole. In this state, an electrolytic treatment solution is made to flow through a space between outer peripheral surfaces of the large-diameter electrode pipe and the small-diameter electrode pipe of the electrode device and the inner wall surface of the bottomed hole and a space inside the hollow small-diameter electrode pipe, and power is applied across the large-diameter electrode pipe and the small-diameter electrode pipe of the electrode device and the casting mold. In the surface treatment device, since the small-diameter electrode pipe of the electrode device has a hollow shape, the space inside the small-diameter electrode pipe is used as a flow passage of the electrolytic treatment solution, and thereby an advantage is obtained in that the electrolytic treatment solution is sufficiently circulated to the bottom part of the bottomed hole.

Patent Document 1: Japanese Unexamined Patent Application, Publication No. 2013-159832

Patent Document 2: Japanese Unexamined Patent Application, Publication No. 2015-030897

DISCLOSURE OF THE INVENTION

Problems to be Solved by the Invention

However, in the surface treatment devices, since a front end of a small-diameter electrode pipe of an electrode or an electrode device is open, there is a lack of a surface area of a region of the small-diameter electrode pipe of the electrode or the electrode device, the region facing the bottom part of the bottomed hole, and thus insufficient surface treatment is implemented at the bottom part of the bottomed hole. Hence, an adhesion state of a treatment layer deteriorates, and thus a thinner film is likely to be formed at the bottom part of the bottomed hole than at other sites. As a result, in order to form a film having a prescribed thickness at the inner wall surface of the bottomed hole, the surface treatment needs to be implemented for a long time, and thus a problem arises in that it is difficult to reduce the time required for the surface treatment.

With consideration for such a circumstance, an object of the invention is to provide a surface treatment device that can easily reduce the time required for surface treatment while maintaining flow of an electrolytic treatment solution.

Means for Solving the Problems

According to the invention, there is provided a surface treatment device (for example, a surface treatment device 10 to be described below) that implements surface treatment at an inner wall surface (for example, an inner wall surface 12*d* or 12*e* to be described below) of a bottomed hole (for example, a bottomed hole 12 to be described below), in which a hollow electrode device (for example, an electrode device 16 to be described below) is inserted into an inside of the bottomed hole, an electrolytic treatment solution is made to flow through the space inside the bottomed hole, and power is applied across the electrode device and the inner wall surface of the bottomed hole, and the electrode device is provided with a closed part (for example, a closed part 15 to be described below) facing a bottom part (for example, a bottom part 12*c* to be described below) of the bottomed hole, when insertion of the electrode device into the inside of the bottomed hole is completed, and a flow through hole (for example, a flow through hole 17 to be described below) linking the inside and outside of the electrode device.

The electrode device may have a hollow large-diameter electrode pipe (for example, a large-diameter electrode pipe 16*a* to be described below) and a hollow small-diameter electrode pipe (for example, a small-diameter electrode pipe 16*b* to be described below) that is inserted into the space inside the large-diameter electrode pipe and projects out of the large-diameter electrode pipe at a front end side. When insertion of the electrode device into the inside of the bottomed hole is completed, a treatment-solution flow passage or example, a second supply passage 37*b*, a third supply passage 37*c* a first collecting passage 49, or a second collecting passage 59 to be described below) through which the electrolytic treatment solution flows may be formed in the space between an outer peripheral surface of the large-diameter electrode pipe and the inner wall surface of the bottomed hole and the space between an inner peripheral surface of the large-diameter electrode pipe and an outer peripheral surface of the small-diameter electrode pipe.

The electrode device may have a hollow bottomed large-diameter electrode pipe (for example, a large-diameter electrode pipe 19*a* to be described below) and a solid small-diameter electrode part (for example, a small-diameter electrode part 19*b* to be described below) that is inserted into the space inside the large-diameter electrode pipe. An inserting-direction front end portion (for example, an inserting-direction front end portion 19*c* to be described below) of the small-diameter electrode part may be coupled to a bottom part (for example, a bottom part 19*d* to be described below) of the large-diameter electrode pipe. At least one flow through hole may be formed at a front end side of the large-diameter electrode pipe in an inserting direction so as to link the inside and outside of the large-diameter electrode pipe. The electrolytic treatment solution may flow into the space between the bottomed hole and the large-diameter electrode pipe, may flow into the space inside the large-diameter electrode pipe from the flow through hole, and may be discharged through the space between the small-diameter electrode part and the large-diameter electrode pipe.

The electrode device may have a hollow large-diameter electrode pipe (for example, a large-diameter electrode pipe 16*a* to be described below) and a hollow small-diameter electrode pipe (for example, a small-diameter electrode pipe 16*b* to be described below) that is inserted into the space inside the large-diameter electrode pipe and projects out of the large-diameter electrode pipe at a front end side. The flow through hole may link the inside and outside of the small-diameter electrode pipe. When insertion of the electrode device into the inside of the bottomed hole is completed, a treatment-solution flow passage (for example, a second supply passage 37*b*, a third supply passage 37*c*, a first collecting passage 49, or a second collecting passage 59 to be described below) through which the electrolytic treatment solution flows may be formed in the space between an outer peripheral surface of the large-diameter electrode pipe and the inner wall surface of the bottomed hole and the space inside the small-diameter electrode pipe.

In the electrode device, at least a region of the small-diameter electrode pipe, in which the flow through hole is formed, may be configured to be supported to freely rotate with respect to the large-diameter electrode pipe, to be disposed asymmetrically in a circumferential direction of the small-diameter electrode pipe, with the flow through hole being inclined with respect to a radial direction of the small-diameter electrode pipe, and thereby to rotate by a reaction force produced during flowing of the electrolytic treatment solution.

In the electrode device, an outer peripheral surface of a region of the small-diameter electrode pipe may be masked to be separated from the electrolytic treatment solution, the region being positioned inside the large-diameter electrode pipe.

The surface treatment device may include power-applying control means that is capable of setting a current value of power which is applied to the large-diameter electrode pipe to a value larger or smaller than a current value of power which is applied to the small-diameter electrode pipe, when power is applied across the electrode device and the inner wall surface of the bottomed hole.

When the electrode device is inserted into the inside of the bottomed hole such that the large-diameter electrode pipe and the small-diameter electrode pipe of the electrode device are disposed in a large-diameter part and a small-diameter part of the bottomed hole, respectively, a distance (for example, a distance L1 to be described below) from the outer peripheral surface of the large-diameter electrode pipe to the inner wall surface of the bottomed hole and a distance (for example, a distance L3 to be described below) from a front end of the small-diameter electrode pipe to the bottom part of the bottomed hole may be set to be substantially equal to each other.

When power is applied across the electrode device and the inner wall surface of the bottomed hole, the electrode device may be an anode, and the inner wall surface of the bottomed hole may be a cathode.

Effects of the Invention

According to the invention, it is possible to provide a surface treatment device that can easily reduce the time required for surface treatment while maintaining flow of an electrolytic treatment solution.

PREFERRED MODE FOR CARRYING OUT THE INVENTION

Hereinafter, a first embodiment of the invention will be described with reference to the drawings.

First Embodiment

Figure 1:
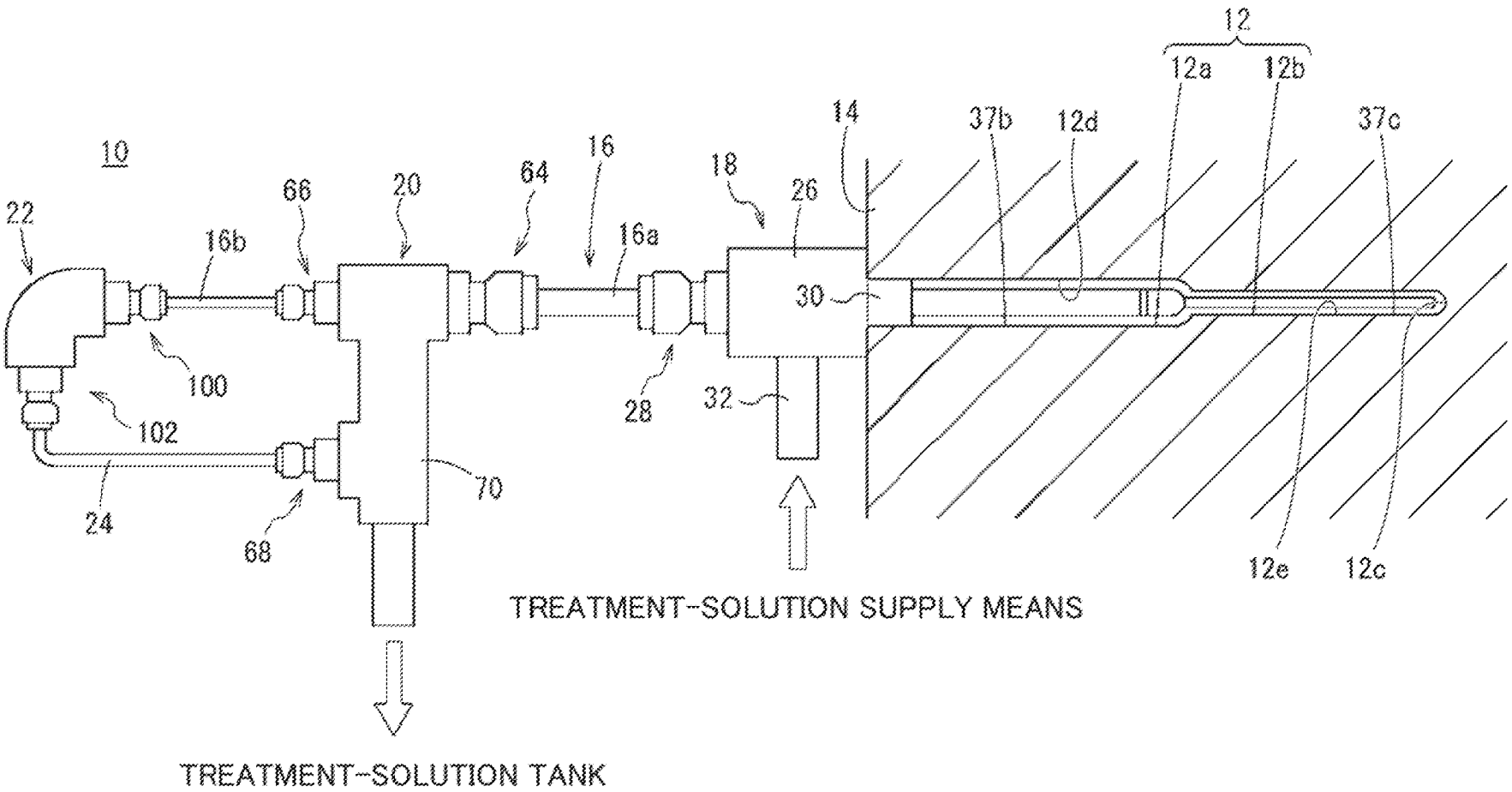
FIG. 1 is a front view illustrating an overall configuration of a surface treatment device according to a first embodiment of the invention.
Figure 2:
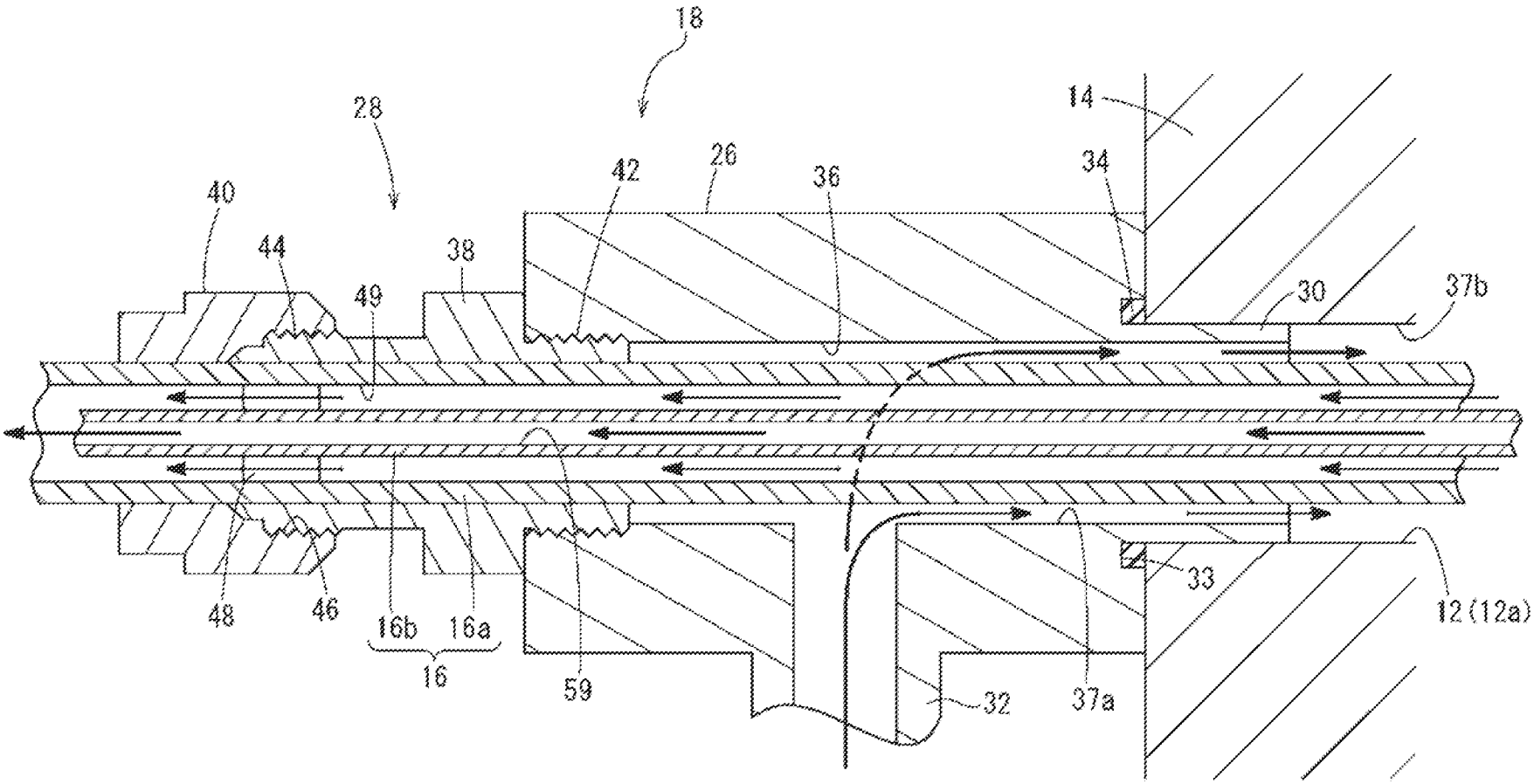
FIG. 2 is a cross-sectional view of a treatment-solution supply unit of the surface treatment device illustrated in FIG. 1.
Figure 3:
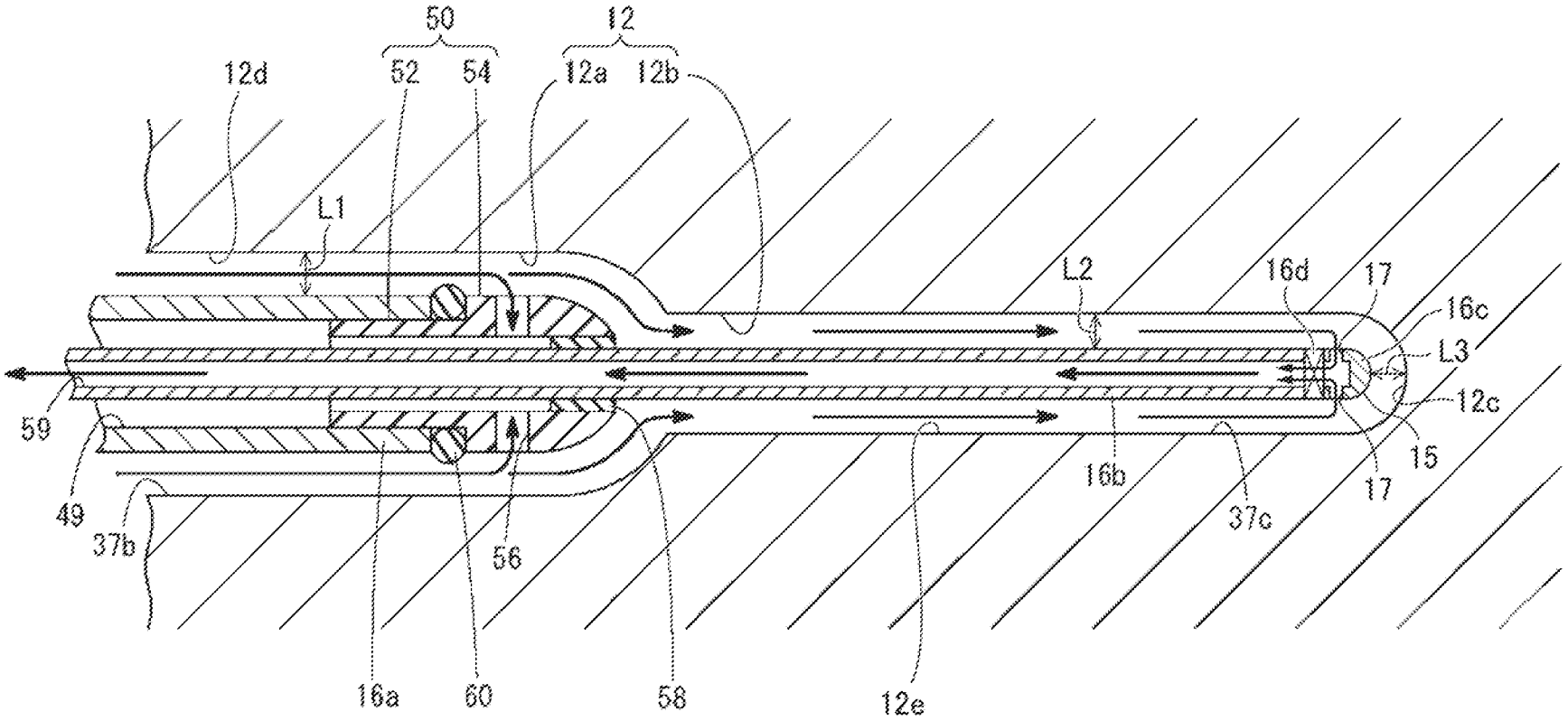
FIG. 3 is a cross-sectional view of an electrode device of the surface treatment device illustrated in FIG. 1.
Figure 4:
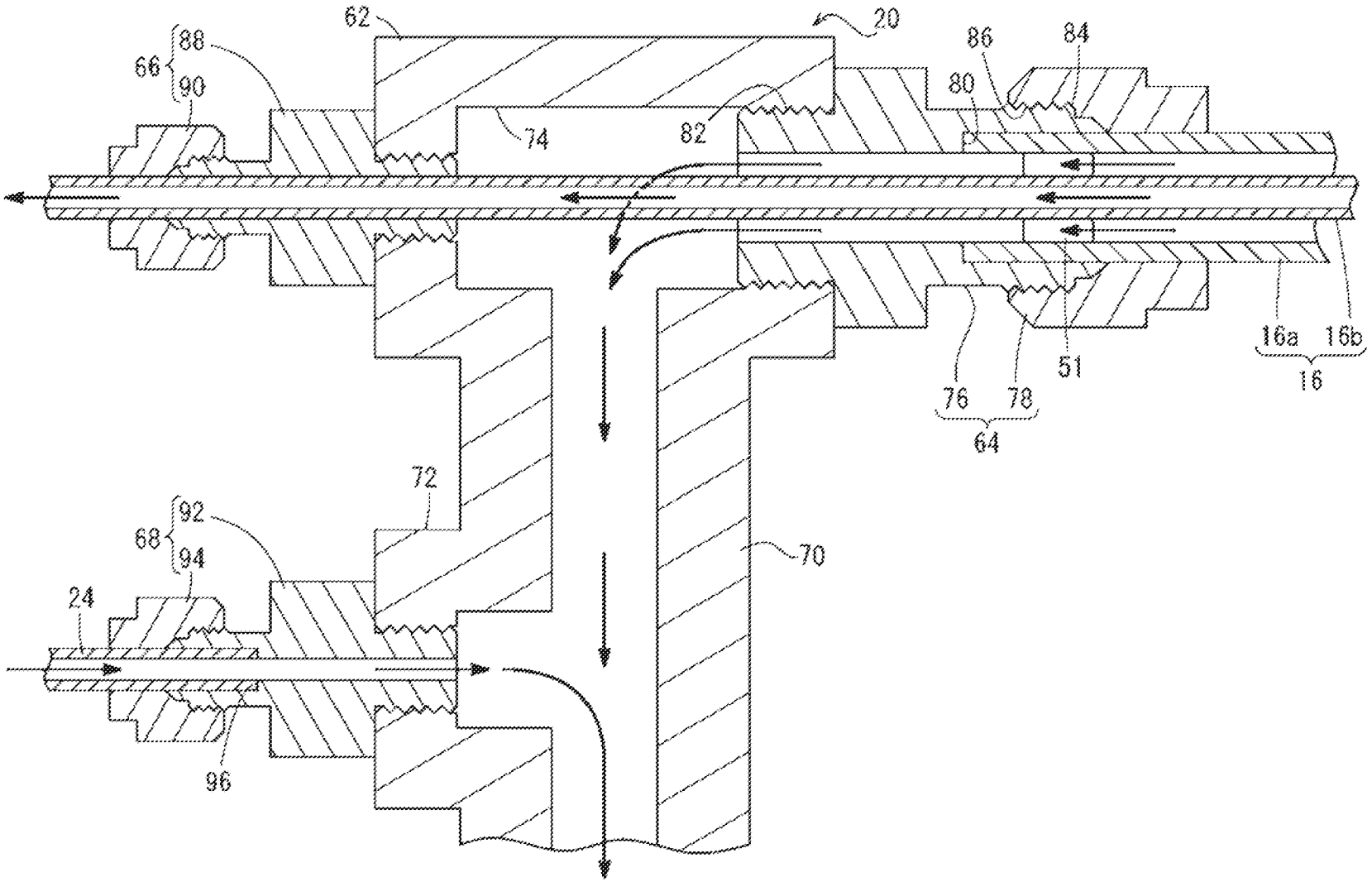
FIG. 4 is a cross-sectional view of a treatment-solution discharge unit of the surface treatment device illustrated in FIG. 1.
Figure 5:
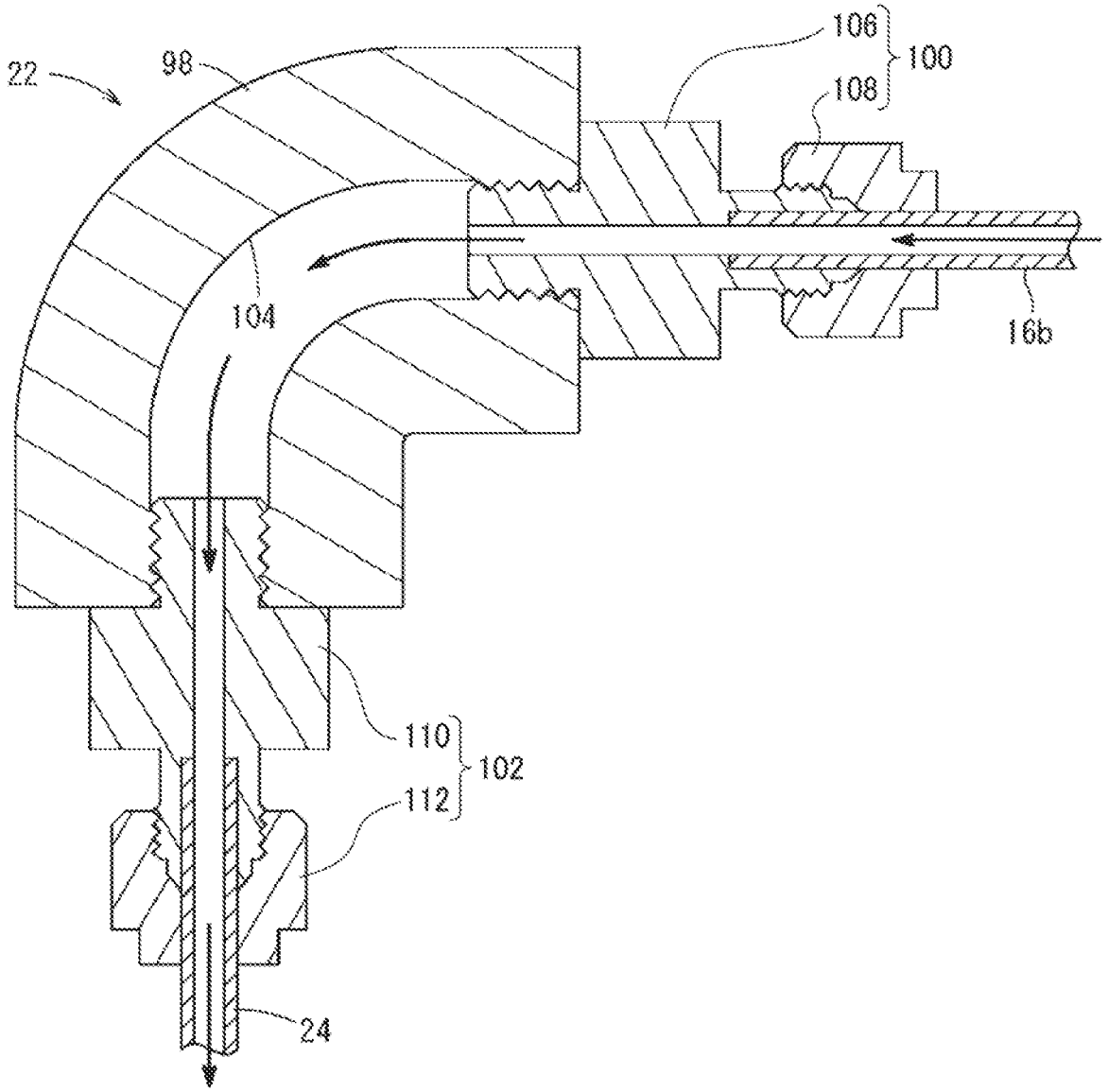
FIG. 5 is a cross-sectional view of a treatment-solution collecting unit of the surface treatment device illustrated in FIG. 1.
Figure 6:
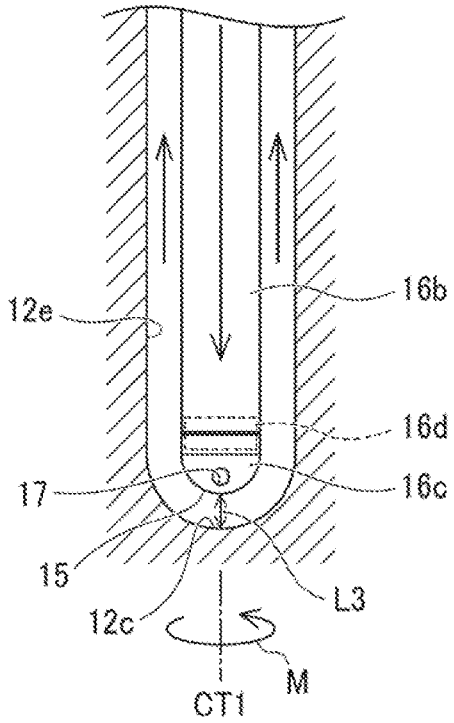
FIG. 6 is a front view of main parts of a small-diameter electrode pipe of the electrode device of the surface treatment device illustrated in FIG. 1.

FIG. 1 is a front view illustrating an overall configuration of a surface treatment device according to the first embodiment of the invention. FIG. 2 is a cross-sectional view of a treatment-solution supply unit of the surface treatment device illustrated in FIG. 1. FIG. 3 is a cross-sectional view of an electrode device of the surface treatment device illustrated in FIG. 1. FIG. 4 is a cross-sectional view of a treatment-solution discharge unit of the surface treatment device illustrated in FIG. 1. FIG. 5 is a cross-sectional view of a treatment-solution collecting unit of the surface treatment device illustrated in FIG. 1. FIG. 6 is a front view of main parts of a small-diameter electrode pipe of the electrode device of the surface treatment device illustrated in FIG. 1.

As illustrated in FIG. 1, a surface treatment device 10 according to the first embodiment is a device that implements electroplating at inner wall surfaces 12*d* and 12*e* of a bottomed hole 12 having a stepped shape, the bottomed hole being formed as a cooling passage in a casting mold 14. The surface treatment device 10 can form a plating film (not illustrated) made of zinc, chromium, gold, silver, copper, tin or the like or an alloy thereof. For example, a plating film made of a zinc alloy can be formed by using an electrolytic treatment solution prepared by mixing zinc chloride, nickel chloride, ammonium chloride, or the like.

The electroplating is implemented at the inner wall surfaces 12*d* and 12*e* of the bottomed hole 12 of the casting mold 14, in order to maintain cooling performance of the casting mold 14 and to reduce the number of times of maintenance thereof. In other words, the casting mold 14 is formed of alloy steel or the like and is cooled with a refrigerant such as water which is supplied into the bottomed hole 12, for example. In this case, when the refrigerant comes into direct contact with the inner wall surfaces 12*d* and 12*e* of the bottomed hole 12, thermal contraction or corrosion begins at the inner wall surfaces 12*d* and 12*e*, scale/slime is accumulated at the inner wall surfaces, the cooling performance of the casting mold 14 deteriorates, and it is difficult to adjust a temperature of the casting mold 14. Therefore, it is necessary to perform maintenance such as removal of accumulated matter or re-plating treatment, and thus a manufacturing line has to be stopped. In this respect, in order to avoid a state in which the inner wall surfaces 12*d* and 12*e* of the bottomed hole 12 comes into direct contact with the refrigerant, a plating film is formed at the inner wall surfaces 12*d* and 12*e* of the bottomed hole 12 by using the surface treatment device 10, and thereby the number of times of maintenance of the casting mold 14 is reduced.

Here, as illustrated in FIG. 1, the bottomed hole 12 of the casting mold 14 has a stepped shape and is configured to have a large-diameter part 12*a* formed at a side of an opening (left side in FIG. 1) and a small-diameter part 12*b* that is formed at a side of a bottom part 12*c* (right side in FIG. 1) and has an inner diameter smaller than that of the large-diameter part 12*a*.

<Overall Configuration of Surface Treatment Device 10>

Next, an overall configuration of the surface treatment device 10 will be described. The surface treatment device 10 includes an electrode device 16, a treatment-solution supply unit 18, a treatment-solution discharge unit 20, a treatment-solution collecting unit 22, and a flexible tube 24.

<Configuration of Electrode Device 16>

The electrode device 16 is a pipe body formed by platinum-coated titanium or the like, for example, and thus a front end of the electrode device 16 is inserted into the bottomed hole 12, the front end projecting out of the treatment-solution supply unit 18, in a state of being inserted into an inside of the bottomed hole 12 of the casting mold 14, as illustrated in FIG. 1. The electrode device 16 has a so-called double pipe structure and is configured to have a hollow large-diameter electrode pipe 16*a* having an outer diameter smaller than the inner diameter of the large-diameter part 12*a* of the bottomed hole 12 and a hollow small-diameter electrode pipe 16*b* having an outer diameter smaller than an inner diameter of the large-diameter electrode pipe 16*a*.

A front end side of the large-diameter electrode pipe 16*a* is inserted into the large-diameter part 12*a* of the bottomed hole 12, and a rear end side thereof is connected to the treatment-solution discharge unit 20. The small-diameter electrode pipe 16*b* is inserted through an inside of the large-diameter electrode pipe 16*a*, in a state of being electrically insulated from the large-diameter electrode pipe 16*a*. In addition, a front end side of the small-diameter electrode pipe 16*b* projects outside out of a front end of the large-diameter electrode pipe 16*a* so as to be inserted into the small-diameter part 12*b* of the bottomed hole 12, in a state in which the electrode device 16 is inserted into the inside of the bottomed hole 12 of the casting mold 14. A rear end side of the small-diameter electrode pipe 16*b* is connected to the treatment-solution collecting unit 22.

An insulation cap 50 is attached to a front end of the large-diameter electrode pipe 16*a*. Consequently, the electrode device 16 and the inner wall surfaces 12*d* and 12*e* of the bottomed hole 12 are prevented from coming into contact with each other, and the large-diameter electrode pipe 16*a* and the small-diameter electrode pipe 16*b* are prevented from coming into contact with each other. The insulation cap 50 is formed into a pipe shape and is made of a material such as silicone rubber or fluororesin having an insulation property and chemical resistance. The insulation cap 50 is formed to have an inner diameter larger than the outer diameter of the small-diameter electrode pipe 16*b*, the small-diameter electrode pipe 16*b* is inserted through the insulation cap 50.

Specifically, the insulation cap 50 is integrally formed by a circular pipe-shaped insertion part 52 that is fitted into the large-diameter electrode pipe 16*a* and a cap part 54 having an outer diameter substantially equal to the outer diameter of the large-diameter electrode pipe 16*a*. The insertion part 52 has an outer diameter equal to or slightly smaller than the inner diameter of the large-diameter electrode pipe 16*a* and is fitted into the inside of the large-diameter electrode pipe 16*a*.

The cap part 54 is formed into a shape corresponding to a shape of a boundary region between the large-diameter part 12*a* and the small-diameter part 12*b* of the bottomed hole 12, and a hemispherical curved surface is formed at a front end of the cap part. Consequently, it is possible to effectively prevent the inner wall surfaces 12*d* and 12*e* of the bottomed hole 12 and the electrode device 16 from coming into contact with each other.

A side wall of the cap part 54 has a through-hole 56 that penetrates the side wall and is linked with an inside of the insulation cap 50. In other words, the through-hole 56 is linked with a space between an outer peripheral surface of the small-diameter electrode pipe 16*b* and an inner wall surface of the insulation cap 50.

In addition, a seal member 58 is sandwiched between an inner wall surface of the cap part 54 and the outer peripheral surface of the small-diameter electrode pipe 16*b*, the inner wall surface being closer to a front end side than the through-hole 56, thereby, sealing the space therebetween. Consequently, an electrolytic treatment solution flowing through a second supply passage 37*b* (space between an inner wall surface of the large-diameter part 12*a* of the bottomed hole 12 and an outer peripheral surface of the large-diameter electrode pipe 16*a*) as a treatment-solution flow passage flows through the through-hole 56 to a first collecting passage 49 formed between the large-diameter electrode pipe 16*a* and the small-diameter electrode pipe 16*b*.

As illustrated in FIG. 3, an O-ring 60 is provided between the insulation cap 50 and the large-diameter electrode pipe 16*a*. The O-ring 60 functions as a joint when the insulation cap 50 is attached to the large-diameter electrode pipe.

In addition, the front end side of the small-diameter electrode pipe 16*b* is extended outside out of the front end of the large-diameter electrode pipe 16*a* via the open insulation cap 50 in the bottomed hole 12 and is disposed in an inside of the small-diameter part 12*b*. A third supply passage 37*c* as a treatment-solution flow passage is formed at a space between the outer peripheral surface of the small-diameter electrode pipe 16*b* and an inner wall surface of the small-diameter part 12*b* of the bottomed hole 12. An electrolytic treatment solution being split without flowing into the through-hole 56 from the second supply passage 37*b* flows through the third supply passage 37*c*.

In addition, the electrolytic treatment solution flowing through the bottom part 12*c* of the bottomed hole 12 can flow into an inside of the small-diameter electrode pipe 16*b* from a front end of the small-diameter electrode pipe 16*b*. In other words, a second collecting passage 59 as a treatment-solution flow passage is formed in the inside of the small-diameter electrode pipe 16*b*.

Meanwhile, as illustrated in FIGS. 3 and 6, only a front end portion 16*c* of the small-diameter electrode pipe 16*b* of the electrode device 16 is supported to freely rotate around an axial core CT1 of the small-diameter electrode pipe 16*b* in an arrow M direction via a bearing 16*d*. The front end portion 16*c* has a closed part 15 facing the bottom part 12*c* of the bottomed hole 12, when the electrode device 16 is inserted into the inside of the bottomed hole 12 of the casting mold 14, and a plurality of (for example, four) flow through holes 17 linking the inside and outside of the small-diameter electrode pipe 16*b* are formed to be disposed at equiangular (for example, 90°) intervals on the circumference.

Incidentally, the closed part 15 is formed into a hemispherical shape corresponding to a shape of the bottom part 12*c* of the bottomed hole 12. In addition, the front end portion 16*c* of the small-diameter electrode pipe 16*b* is disposed asymmetrically (for example, in a triangular shape or a teardrop shape) in a circumferential direction of the small-diameter electrode pipe 16*b*, with the flow through holes 17 being inclined with respect to a radial direction of the small-diameter electrode pipe 16*b*, and thereby the front end portion 16*c* is configured to rotate by a reaction force produced during flowing of the electrolytic treatment solution.

Further, in the electrode device 16, an outer peripheral surface of a region of the small-diameter electrode pipe 16*b* is masked to be separated from the electrolytic treatment solution, the region being positioned inside the large-diameter electrode pipe 16*a*.

<Configuration of Treatment-Solution Supply Unit 18>

As illustrated in FIG. 2, the treatment-solution supply unit 18 has a main-body member 26 that is detachably attached to the bottomed hole 12 and a first male connector 28 that fixes the electrode device 16 to the main-body member 26.

The main-body member 26 has a circular pipe-shaped insertion part 30 that is inserted into the bottomed hole 12 and a treatment-solution supply pipe 32 that is connected to treatment-solution supply means, both the insertion part and the treatment-solution supply pipe being formed in a projecting manner. The insertion part 30 has an outer diameter equal to or slightly smaller than an inner diameter of the bottomed hole 12 (large-diameter part 12*a*) in the vicinity of an opening. The insertion part 30 is fitted into the bottomed hole 12, and thereby it is possible to detachably attach the main-body member 26 to the bottomed hole 12.

An annular groove 33 is formed in the main-body member 26, and a seal member 34 is installed in the annular groove 33. The seal member 34 seals a space between the casting mold 14 and the main-body member 26.

The main-body member 26 has an electrode penetrating hole 36 that penetrates an inside of the main-body member 26. The insertion part 30 is inserted into the bottomed hole 12, and thereby the bottomed hole 12 is linked with the electrode penetrating hole 36. The electrode penetrating hole 36 is a through-hole having an inner diameter larger than the outer diameter of the large-diameter electrode pipe 16*a*, and thus the electrode device 16 (large-diameter electrode pipe 16*a* and small-diameter electrode pipe 16*b*) penetrates an inside of the electrode penetrating hole 36. In addition, the first male connector 28 is attached to a left end portion of the electrode penetrating hole 36. Consequently, a relative position of the large-diameter electrode pipe 16*a* with respect to the electrode penetrating hole 36 is fixed, and a space between the outer peripheral surface of the large-diameter electrode pipe 16*a* and an inner wall surface of the electrode penetrating hole 36 is sealed.

The electrode penetrating hole 36 is linked with an inside of the treatment-solution supply pipe 32 in the main-body member 26. Hence, the electrolytic treatment solution supplied from the treatment-solution supply means via the treatment-solution supply pipe 32 is supplied into the bottomed hole 12 through the space between the outer peripheral surface of the large-diameter electrode pipe 16*a* and the inner wall surface of the electrode penetrating hole 36.

In other words, a supply passage of the electrolytic treatment solution is formed between the outer peripheral surface of the large-diameter electrode pipe 16*a* and inner walls of the electrode penetrating hole 36 and the bottomed hole 12. Hereinafter, for convenience of description, a supply passage between the outer peripheral surface of the large-diameter electrode pipe 16*a* and the inner wall surface of the electrode penetrating hole 36, a supply passage between the outer peripheral surface of the large-diameter electrode pipe 16*a* and the inner wall surface 12*d* of the large-diameter part 12*a*, and a supply passage between the outer peripheral surface of the small-diameter electrode pipe 16*b* and the inner wall surface 12*e* of the small-diameter part 12*b* are referred to as a "first supply passage", the "second supply passage", and the "third supply passage", respectively, and are represented by reference signs of 37*a*, 37*b*, and 37*c*, respectively.

The first male connector 28 is configured to have a main connector body 38 and a fastening member 40, and the electrode device 16 (large-diameter electrode pipe 16*a* and small-diameter electrode pipe 16*b*) is inserted through an inside of the first male connector. A male screw 42 is formed at an outer peripheral surface at one end side of the main connector body 38, and the male screw 42 is screwed in the electrode penetrating hole 36. In this manner, the main connector body 38 is connected to the main-body member 26. At the same time, it is possible to seal a space between an inner wall surface at a left end of the electrode penetrating hole 36 and the outer peripheral surface of the large-diameter electrode pipe 16*a*.

In addition, a male screw 44 is formed at an outer peripheral surface of a left end of the main connector body 38. The male screw 44 is screwed with a female screw 46 formed at an inner peripheral surface of the fastening member 40, and thereby a fastening force is applied to the large-diameter electrode pipe 16*a* of the electrode device 16 in the first male connector 28. That is, an insertion length of the large-diameter electrode pipe 16*a* is adjusted in a depth direction of the bottomed hole 12, and then a fastening force is applied by the fastening member 40. Consequently, the large-diameter electrode pipe 16*a* is positioned in a state in which the insertion length has been adjusted.

Incidentally, in the electrode device 16, a spacer 48 for preventing the large-diameter electrode pipe 16*a* and the small-diameter electrode pipe 16*b* from coming into contact with each other is disposed between the small-diameter electrode pipe 16*b* and the large-diameter electrode pipe 16*a* to which the fastening force is applied. A space between the large-diameter electrode pipe 16*a* and the small-diameter electrode pipe 16*b* becomes the first collecting passage 49 for collecting the electrolytic treatment solution. Therefore, the spacer 48 has a through-hole along a flow-through direction (extension direction of the first collecting passage 49) such that the electrolytic treatment solution flows through without interruption.

<Configuration of Treatment-Solution Discharge Unit 20>

As illustrated in FIG. 4, the treatment-solution discharge unit 20 has a main-body member 62, a second male connector 64, a third male connector 66, and a fourth male connector 68. A treatment-solution discharge pipe 70 is formed to project from the main-body member 62, the treatment-solution discharge pipe being connected to a treatment-solution tank. In addition, a junction pipe 72 is formed to project from a side wall of the treatment-solution discharge pipe 70. The main-body member 62 has a small-diameter-electrode pipe penetrating hole 74 which penetrates an inside of the main-body member 62 and through which the small-diameter electrode pipe 16*b* is inserted. The small-diameter-electrode pipe penetrating hole 74 is linked with an inside of the treatment-solution discharge pipe 70. In addition, an inside of the treatment-solution discharge pipe 70 is linked with an inside of the junction pipe 72.

A rear end portion of the large-diameter electrode pipe 16*a* is connected to the small-diameter-electrode pipe penetrating hole 74 via the second male connector 64. In addition, an end portion of the flexible tube 24 is connected to the junction pipe 72 via the fourth male connector 68.

All of the second male connector 64, the third male connector 66, and the fourth male connector 68 have the same configuration as that of the first male connector 28 described above, basically. In other words, the second male connector 64 has a main connector body 76 and a fastening member 78. A step part 80 having a height substantially equal to a wall thickness of the large-diameter electrode pipe 16*a* is formed in an inside of the main connector body 76, and the rear end portion of the large-diameter electrode pipe 16*a* is in contact with the step part 80. Consequently, the large-diameter electrode pipe 16*a* is positioned with respect to the main connector body 76.

In addition, a male screw 82 formed at an outer peripheral surface of a left end of the main connector body 76 is screwed in the small-diameter-electrode pipe penetrating hole 74, and thereby the main connector body 76 is connected to the main-body member 62. On the other hand, a male screw 84 formed at an outer peripheral surface of a right end of the main connector body 76 is screwed with a female screw 86 of the fastening member 78, and thereby a fastening force is applied to the large-diameter electrode pipe 16*a* inserted through the second male connector 64. Consequently, the small-diameter-electrode pipe penetrating hole 74 of the main-body member 62 and the inside of the large-diameter electrode pipe 16*a* are linked in a sealed state from the outside. Hence, the electrolytic treatment solution flowing through the first collecting passage 49 flows through the small-diameter-electrode pipe penetrating hole 74 via the second male connector 64 and is sent into the treatment-solution discharge pipe 70.

Incidentally, in the electrode device 16, a spacer 51 for preventing the large-diameter electrode pipe 16*a* and the small-diameter electrode pipe 16*b* from coming into contact with each other is disposed between the small-diameter electrode pipe 16*b* and the large-diameter electrode pipe 16*a* to which the fastening force is applied. A space between the large-diameter electrode pipe 16*a* and the small-diameter electrode pipe 16*b* becomes the first collecting passage 49 for collecting the electrolytic treatment solution. Therefore, the spacer 51 has a through-hole along a flow-through direction (extension direction of the first collecting passage 49) such that the electrolytic treatment solution flows through without interruption.

The third male connector 66 has a main connector body 88 and a fastening member 90. The main connector body 88 is screwed in the small-diameter-electrode pipe penetrating hole 74, and thereby the third male connector 66 is attached to the main-body member 62. In addition, the fastening member 90 is screwed with the main connector body 88, and thereby a fastening force is applied to the small-diameter electrode pipe 16*b*. In other words, an insertion length of the small-diameter electrode pipe 16*b* with respect to the bottomed hole 12 is adjusted, and then, a fastening force is applied by the fastening member 90. In this manner, the insertion length of the small-diameter electrode pipe 16*b* is freely adjusted with respect to the bottomed hole 12. In addition, in a state in which a space between the outer peripheral surface of the small-diameter electrode pipe 16*b* and an inner wall surface of the small-diameter-electrode pipe penetrating hole 74 is sealed, it is possible to fix the small-diameter electrode pipe 16*b* to the main-body member 62.

The fourth male connector 68 has a main connector body 92 and a fastening member 94. The main connector body 92 is screwed with the junction pipe 72, and thereby the fourth male connector 68 is attached to the main-body member 62. In addition, a step part 96 having a height substantially equal to a wall thickness of the flexible tube 24 is formed in an inside of the main connector body 92. One end portion of the flexible tube 24 is in contact with the step part 96, and thereby the flexible tube 24 is fixed to the main connector body 92.

In other words, an inside of the flexible tube 24 and the junction pipe 72 are coupled to each other via the fourth male connector 68 in a sealed state from the outside. Consequently, the electrolytic treatment solution flowing through inside of the flexible tube 24 flows through the junction pipe 72 via the fourth male connector 68 and is sent into the treatment-solution discharge pipe 70.

<Configuration of Treatment-Solution Collecting Unit 22>

As illustrated in FIG. 5, the treatment-solution collecting unit 22 has an elbow-type main-body member 98, a fifth male connector 100, and a sixth male connector 102. A collecting hole 104 is formed to penetrate an inside of the main-body member 98.

The fifth male connector 100 has a main connector body 106 and a fastening member 108. The main connector body 106 is screwed at a right end side of the collecting hole 104, and thereby the fifth male connector 100 is attached to the main-body member 98. In addition, the fastening member 108 is screwed with the main connector body 106, and thereby a fastening force is applied to the small-diameter electrode pipe 16*b*.

The sixth male connector 102 has a main connector body 110 and a fastening member 112. The main connector body 110 is screwed at a lower end side of the collecting hole 104, and thereby the sixth male connector 102 is attached to the main-body member 98. In addition, the fastening member 112 is screwed with the main connector body 110, and thereby a fastening force is applied to the flexible tube 24.

<Configuration of Flexible Tube 24>

The flexible tube 24 is a pipe body having flexibility, which is made of a resin, rubber, metal, or another material. The treatment-solution collecting unit 22 and the treatment-solution discharge unit 20 are connected to each other via the flexible tube 24.

Incidentally, the surface treatment device 10 further includes treatment-solution supply means, a treatment-solution tank, and an external power supply (all not illustrated), in addition to configurational elements described above. The treatment-solution supply means supplies the electrolytic treatment solution into the bottomed hole 12 via the treatment-solution supply unit 18. The treatment-solution tank stores the electrolytic treatment solution discharged via the treatment-solution discharge unit 20. The external power supply supplies a current across the electrode device 16 and the casting mold 14 and produces a potential difference between the electrode device 16 and the inner wall surfaces 12*d* and 12*e* of the bottomed hole 12. In this case, the external power supply is capable of supplying a current having a different magnitude to each of the large-diameter electrode pipe 16*a* and the small-diameter electrode pipe 16*b* of the electrode device 16.

<Procedure of Electroplating>

The surface treatment device 10 has the configuration described above, and thus the electroplating is implemented by using the surface treatment device 10 in accordance with the following procedure, when the electroplating is implemented at the inner wall surfaces 12*d* and 12*e* of the bottomed hole 12 of the casting mold 14.

First, in a state in which the large-diameter electrode pipe 16*a* projects out of the insertion part 30 of the treatment-solution supply unit 18 by a prescribed length such that the large-diameter electrode pipe 16*a* is disposed in the large-diameter part 12*a*, a fastening force is applied to the large-diameter electrode pipe 16*a* by the first male connector 28 and the second male connector 64. Consequently, the large-diameter electrode pipe 16*a* is fixed to the treatment-solution supply unit 18 and the treatment-solution discharge unit 20.

Next, in a state in which the small-diameter electrode pipe 16*b* projects out of the front end of the large-diameter electrode pipe 16*a* by a prescribed length so as to be disposed in the small-diameter part 12*b*, a fastening force is applied to the small-diameter electrode pipe 16*b* by the third male connector 66 and the fifth male connector 100. Consequently, the small-diameter electrode pipe 16*b* is fixed to the treatment-solution discharge unit 20 and the treatment-solution collecting unit 22.

Further, the insulation cap 50 is attached to the front end of the large-diameter electrode pipe 16*a*.

In this state, as illustrated in FIG. 1, the electrode device 16 is inserted into the bottomed hole 12 having the stepped shape, and the insertion part 30 is fitted in the vicinity of the opening of the bottomed hole 12. Then, the electrode device 16 comes into a state in which the large-diameter electrode pipe 16*a* is separated from the inner wall surface 12*d* of the large-diameter part 12*a* of the bottomed hole 12 by a prescribed distance L1 so as to be electrically insulated, and the small-diameter electrode pipe 16*b* is separated from the inner wall surface 12*e* of the small-diameter part 12*b* of the bottomed hole 12 by a prescribed distance L2 so as to be electrically insulated.

In this case, the electrode device 16 has a configuration in which a projecting length of the small-diameter electrode pipe 16*b* is appropriately adjusted depending on a depth of the small-diameter part 12*b* of the bottomed hole 12 in advance, and thereby the distance L1 from the outer peripheral surface of the large-diameter electrode pipe 16*a* to the inner wall surface 12*d* of the bottomed hole 12 and a distance L3 from the front end of the small-diameter electrode pipe 16*b* to the bottom part 12*c* of the bottomed hole 12 become substantially equal to each other (L1≈L3).

Next, the electrolytic treatment solution is made to flow through the space inside the bottomed hole 12. For this, the electrolytic treatment solution is supplied from the treatment-solution supply means to the treatment-solution supply pipe 32. Then, as illustrated in FIG. 2, the electrolytic treatment solution is supplied into the bottomed hole 12 through the first supply passage 37*a*. Afterwards, as illustrated in FIG. 3, the electrolytic treatment solution flows to the front end of the large-diameter electrode pipe 16*a*, and then a part of the electrolytic treatment solution flows through the first collecting passage 49 via the through-hole 56, and the rest thereof flows through the third supply passage 37*c* and then flows through the second collecting passage 59 in the small-diameter electrode pipe 16*b* from the plurality of flow through holes 17.

In this manner, as illustrated in FIG. 4, the electrolytic treatment solution flowing through the first collecting passage 49 flows through the treatment-solution discharge pipe 70 via the small-diameter-electrode pipe penetrating hole 74 in the treatment-solution discharge unit 20 and is discharged from the treatment-solution discharge pipe 70 to the treatment-solution tank.

On the other hand, as illustrated in FIG. 5, the electrolytic treatment solution flowing through the second collecting passage 59 flows into the flexible tube 24 via the collecting hole 104 in the treatment-solution collecting unit 22. Consequently, as illustrated in FIG. 4, the electrolytic treatment solution flows through the junction pipe 72 of the treatment-solution discharge unit 20 via the flexible tube 24, and the electrolytic treatment solution converges with the electrolytic treatment solution from the small-diameter-electrode pipe penetrating hole 74 and is discharged to the treatment-solution tank in the treatment-solution discharge pipe 70.

When the electrolytic treatment solution is made to flow through the space inside the bottomed hole 12 as described above, and the electrolytic treatment solution flows from the third supply passage 37*c* through the flow through holes 17 of the small-diameter electrode pipe 16*b* to the second collecting passage 59 in the small-diameter electrode pipe 16*b*, the front end portion 16*c* of the small-diameter electrode pipe 16*b* rotates in the arrow M direction by a reaction force produced during flowing of the electrolytic treatment solution.

In this state, the external power supply applies power across the electrode device 16 and the inner wall surfaces 12*d* and 12*e* of the bottomed hole 12. In this case, the electrode device 16 is an anode, and the inner wall surfaces 12*d* and 12*e* of the bottomed hole 12 (casting mold 14) is a cathode. In addition, power-applying control means (not illustrated) sets a current value of power which is applied to the large-diameter electrode pipe 16*a* to a value larger or smaller than a current value of power which is applied to the small-diameter electrode pipe 16*b*.

Then, through the electroplating, a plating film is formed at the inner wall surfaces 12*d* and 12*e* of the bottomed hole 12 of the casting mold 14. In this case, the front end portion 16*c* of the small-diameter electrode pipe 16*b* has the closed part 15, and thus the closed part 15 as the electrode faces the bottom part 12*c* of the bottomed hole 12 across a prescribed surface area. Therefore, when the electroplating is implemented at the inner wall surfaces 12*d* and 12*e* of the bottomed hole 12, the electroplating at the bottom part 12*c* of the bottomed hole 12 can proceed to the same extent as the electroplating at other sites. Furthermore, the front end portion 16*c* of the small-diameter electrode pipe 16*b* has the flow through holes 17, and thus the flow through holes 17 enables flow of the electrolytic treatment solution to be maintained. Hence, it is possible to easily reduce the time required for the electroplating while maintaining the flow of the electrolytic treatment solution.

In addition, since the distance L1 from the outer peripheral surface of the large-diameter electrode pipe 16*a* to the inner wall surface 12*d* of the bottomed hole 12 and the distance L3 from the front end of the small-diameter electrode pipe 16*b* to the bottom part 12*c* of the bottomed hole 12 are substantially equal to each other, it is possible to form a uniform plating film in a depth direction of the bottomed hole 12.

Furthermore, since the front end portion 16*c* of the small-diameter electrode pipe 16*b* rotates, the plurality of flow through holes 17 formed at the front end portion 16*c* also rotate, and thus it is possible to form a uniform plating film in a circumferential direction of the bottomed hole 12.

Further, in the electrode device 16, since the outer peripheral surface of the region of the small-diameter electrode pipe 16*b* is masked to be separated from the electrolytic treatment solution, the region being positioned inside the large-diameter electrode pipe 16*a*, an electrochemical reaction is prevented at this masked region, the electrochemical reaction intensively occurs only at a projecting region (that is, region facing the inner wall surface 12*e* of the small-diameter part 12*b* of the bottomed hole 12) of the small-diameter electrode pipe 16*b*. Therefore, it is possible to sufficiently implement the electroplating at the inner wall surface 12*e* of the small-diameter part 12*b* of the bottomed hole 12.

In addition, since the current value of power which is applied to the large-diameter electrode pipe 16*a* is larger than the current value of power which is applied to the small-diameter electrode pipe 16*b*, a thickness of a plating film formed at the bottom part 12*c* of the bottomed hole 12 can be thicker than a thickness of a plating film formed at other sites.

Here, the surface treatment device 10 ends the electroplating.

Second Embodiment

Figure 7:
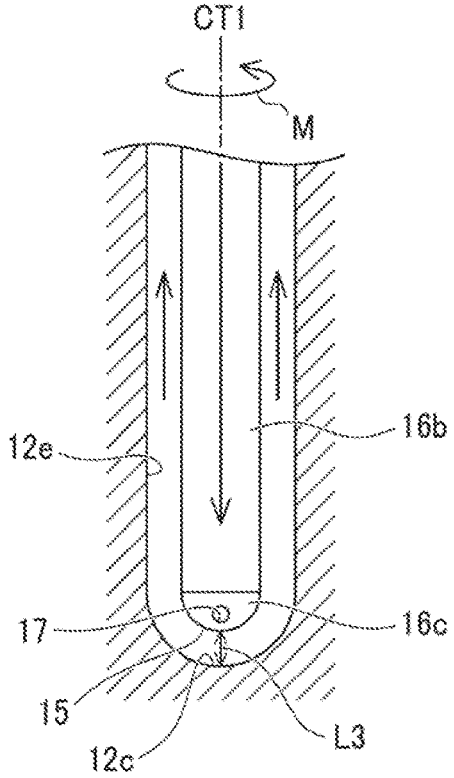
FIG. 7 is a front view of main parts of a small-diameter electrode pipe of an electrode device of a surface treatment device according to a second embodiment of the invention.

FIG. 7 is a front view of main parts of a small-diameter electrode pipe of an electrode device of a surface treatment device according to a second embodiment of the invention.

As illustrated in FIG. 7, a surface treatment device 10 according to the second embodiment has the same configuration as that of the first embodiment described above except that the entire small-diameter electrode pipe 16*b* of the electrode device 16 is configured to rotate by a motor (not illustrated). Incidentally, the same reference numerals are assigned to the same members as those of the first embodiment, and thus the description thereof is omitted.

Hence, in the second embodiment, the same operational effects as those of the first embodiment described above are achieved. Additionally, since the bearing 16*d* is not provided in the small-diameter electrode pipe 16*b* of the electrode device 16, the small-diameter electrode pipe 16*b* can be simplified accordingly.

Third Embodiment

Figure 8:
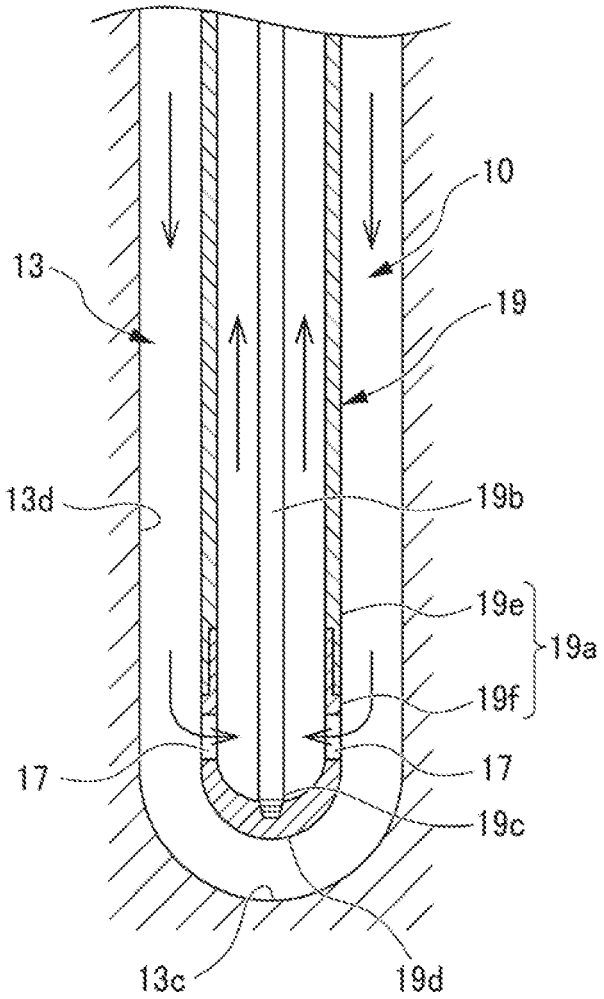
FIG. 8 is a cross-sectional view illustrating an electrode device of a surface treatment device according to a third embodiment of the invention.

FIG. 8 is a cross-sectional view illustrating an electrode device of a surface treatment device according to a third embodiment of the invention.

As illustrated in FIG. 8, a surface treatment device 10 according to the third embodiment is a device that implements electroplating at an inner wall surface 13*d* of a bottomed hole 13 having a non-stepped shape (that is, shape having a constant size of an inner diameter from an opening to a bottom part of the bottomed hole). The surface treatment device 10 includes an electrode device 19. As illustrated in FIG. 8, the electrode device 19 has a hollow bottomed large-diameter electrode pipe 19*a* and a solid small-diameter electrode part 19*b* that is inserted into the space inside the large-diameter electrode pipe 19*a*. An inserting-direction front end portion 19*c* of the small-diameter electrode part 19*b* is coupled and electrically connected to a bottom part 19*d* of the large-diameter electrode pipe 19*a*, with the front end portion being screwed in the bottom part 19*d* of the large-diameter electrode pipe 19*a*. At least one flow through hole 17 is formed at a front end side of the large-diameter electrode pipe 19*a* in an inserting direction so as to link the inside and outside of the large-diameter electrode pipe 19*a*. Incidentally, the large-diameter electrode pipe 19*a* is configured to have a substantially hemispherical front end member 19*f* which is screwed to be joined to a cylindrical pipe member 19*e*.

The other configurations (for example, the surface treatment device 10 includes the treatment-solution supply unit 18, the treatment-solution discharge unit 20, the treatment-solution collecting unit 22, and the flexible tube 24, in addition to the electrode device 19) are the same as that of the first embodiment described above.

In this manner, the surface treatment device 10 according to the third embodiment is used to implement electroplating in accordance with the same procedure as that of the first embodiment described above, when the electroplating is implemented at the inner wall surface 13*d* of the bottomed hole 13.

However, when the electrolytic treatment solution is made to flow through a space inside the bottomed hole 13, the electrolytic treatment solution is made to flow into a space between the bottomed hole 13 and the large-diameter electrode pipe 19*a* and to flow into a space inside the large-diameter electrode pipe 19*a* from the flow through hole 17 and is discharged through a space between the small-diameter electrode part 19*b* and the large-diameter electrode pipe 19*a*, as illustrated by an arrow in FIG. 8.

In this state, when power is applied across the electrode device 19 and the inner wall surface 13*d* of the bottomed hole 13, the electroplating is implemented at the inner wall surface 13*d* of the bottomed hole 13. In this case, since the inserting-direction front end portion 19*c* of the small-diameter electrode part 19*b* is electrically connected to the bottom part 19*d* of the large-diameter electrode pipe 19*a*, as described above, power can be applied in a state of having a high current value of the bottom part 19*d*. As a result, it is possible to implement thick electroplating at the bottom part 13*c* of the bottomed hole 13 facing the bottom part 19*d* of the large-diameter electrode pipe 19*a*.

Other Embodiments

As described above, the embodiments of the invention are described; however, the invention is not limited to the above-described embodiments. In addition, the effects described in the embodiments are only a list of the most preferred effects achieved by the invention, and effects of the invention are not limited to the effects described in the embodiments.

For example, in the description of the first and second embodiments described above, the surface treatment device 10 has the configuration in which the electrolytic treatment solution flows from the third supply passage 37*c* through the flow through holes 17 of the small-diameter electrode pipe 16*b* to the second collecting passage 59 in the small-diameter electrode pipe 16*b*. However, conversely, the invention can also be similarly applied also to a case where the electrolytic treatment solution flows from the second collecting passage 59 in the small-diameter electrode pipe 16*b* through the flow through holes 17 of the small-diameter electrode pipe 16*b* to the third supply passage 37*c*.

In addition, in the description of the first and second embodiments described above, the surface treatment device 10 includes the electrode device 16 having the double pipe structure in which the hollow small-diameter electrode pipe 16*b* is inserted through the inside of the hollow large-diameter electrode pipe 16*a*. However, the small-diameter electrode pipe 16*b* can be formed to be solid. In this case, a space between the outer peripheral surface of the large-diameter electrode pipe 16*a* and the inner wall surface 12*d* of the bottomed hole 12 and a space between the inner peripheral surface of the large-diameter electrode pipe 16*a* and the outer peripheral surface of the small-diameter electrode pipe 16*b* are used as a treatment-solution flow passage, and thereby the electrolytic treatment solution can be made to flow through the space inside the bottomed hole 12.

In addition, in the description of the first and second embodiments described above, the surface treatment device 10 includes the electrode device 16 having the double pipe structure that can correspond to the bottomed hole 12 having the stepped shape. However, the invention can be similarly applied also to a case where the surface treatment is implemented at an inner wall surface of a bottomed hole having a non-stepped shape (that is, shape having a constant size of an inner diameter from an opening to a bottom part of the bottomed hole).

In addition, in the description of the first to third embodiments described above, the electroplating is implemented at the inner wall surface 12*d*, 12*e*, or 13*d* of the bottomed hole 12 or 13 which is formed as a cooling passage in the casting mold 14. However, the bottomed hole is not limited to the bottomed hole 12 or 13, and the invention can be similarly applied also to a case where the electroplating is implemented at an inner wall surface of another bottomed hole.

In addition, in the description of the first to third embodiments described above, the electroplating is implemented at the bottomed hole 12 or 13 of the casting mold 14. However, the invention can be similarly applied not only to the bottomed hole 12 or 13 but also to a line cooling passage which is a bent cooling link passage inside the casting mold 14.

Further, in the first to third embodiments described above, the surface treatment device 10 that implements the electroplating is described. However, the invention can be similarly applied also to a surface treatment device that implements a surface treatment (for example, electrolytic etching, electrolytic degreasing, electrodeposition coating, anodic oxidation, cathodic oxidation, or electrolytic polishing), in addition to the electroplating.

EXPLANATION OF REFERENCE NUMERALS

10 SURFACE TREATMENT DEVICE
12 BOTTOMED HOLE
12*a* LARGE-DIAMETER PART
12*b* SMALL-DIAMETER PART
12*c* BOTTOM PART
12*d*, 12*e* INNER WALL SURFACE
13 BOTTOMED HOLE
13*d* INNER WALL SURFACE
14 CASTING MOLD
15 CLOSED PART
16 ELECTRODE DEVICE
16*a* LARGE-DIAMETER ELECTRODE PIPE
16*b* SMALL-DIAMETER ELECTRODE PIPE
16*c* FRONT END PORTION
17 FLOW THROUGH HOLE
19 ELECTRODE DEVICE
19*a* LARGE-DIAMETER ELECTRODE PIPE
19*b* SMALL-DIAMETER ELECTRODE PART
19*c* INSERTING-DIRECTION FRONT END PORTION
19*d* BOTTOM PART
L1 DISTANCE FROM OUTER PERIPHERAL SURFACE OF LARGE-DIAMETER ELECTRODE PIPE TO INNER WALL SURFACE OF BOTTOMED HOLE
L2 DISTANCE FROM OUTER PERIPHERAL SURFACE OF SMALL-DIAMETER ELECTRODE PIPE TO INNER WALL SURFACE OF BOTTOMED HOLE
L3 DISTANCE FROM FRONT END OF SMALL-DIAMETER ELECTRODE PIPE TO BOTTOM PART OF BOTTOMED HOLE
37*b* SECOND SUPPLY PASSAGE (TREATMENT-SOLUTION FLOW PASSAGE)
37*c* THIRD SUPPLY PASSAGE (TREATMENT-SOLUTION FLOW PASSAGE)
49 FIRST COLLECTING PASSAGE (TREATMENT-SOLUTION FLOW PASSAGE)
59 SECOND COLLECTING PASSAGE (TREATMENT-SOLUTION FLOW PASSAGE)

The invention claimed is:

1. A surface treatment device for applying surface treatment at an inner wall surface of a bottomed hole, the surface treatment device comprising:

a hollow electrode device having a hollow large-diameter electrode pipe and a hollow small-diameter electrode pipe that is inserted into a space inside the hollow large-diameter electrode pipe and extending outward from the hollow large-diameter electrode pipe at a front end side thereof, wherein the hollow electrode device is inserted into an inside of the bottomed hole, so that an electrolytic treatment solution flows through a space between the inside of the bottomed hole and the hollow electrode device;

an external power supply connected across the hollow electrode device and the inner wall surface of the bottomed hole;

a closing cap rotatably provided at a front end portion of the hollow small-diameter electrode pipe, so as to close the front end portion thereof facing a bottom part of the bottomed hole; and a plurality of through hole channels defined in the closing cap linking an inside and an outside of the hollow small-diameter electrode pipe such that the through hole channels are inclined with respect to a radial direction of the hollow small-diameter electrode pipe, so as to allow the electrolytic treatment solution to flow through the closing cap and rotate the closing cap by a reaction force produced during flowing of the electrolytic treatment solution, wherein the closing cap is formed into a hemispherical shape corresponding to a shape of the bottom part of the bottomed hole.

2. The surface treatment device according to claim 1, wherein the external power supply is capable of setting a current value of power which is applied to the hollow large-diameter electrode pipe to a value larger or smaller than a current value of power which is applied to the hollow small-diameter electrode pipe.

3. The surface treatment device according to claim 1, wherein, when the electrode device is inserted into the inside of the bottomed hole such that the hollow large-diameter electrode pipe and the hollow small-diameter electrode pipe of the electrode device are disposed in a large-diameter part and a small-diameter part of the bottomed hole, respectively, a distance from the outer peripheral surface of the hollow large-diameter electrode pipe to the inner wall surface of the bottomed hole and a distance from a front end of the hollow small-diameter electrode pipe to the bottom part of the bottomed hole are set to be substantially equal to each other.

4. The surface treatment device according to claim 1, wherein, the external power supply applies voltage across the hollow electrode device and the inner wall surface of the bottomed hole, the hollow electrode device is an anode, and the inner wall surface of the bottomed hole is a cathode.

* * * * *